US008875754B2

(12) United States Patent
Eyre

(10) Patent No.: US 8,875,754 B2
(45) Date of Patent: Nov. 4, 2014

(54) FUNNEL CAP

(71) Applicant: Matthew Eyre, Brockville (CA)

(72) Inventor: Matthew Eyre, Brockville (CA)

( * ) Notice: Subject to any disclaimer, the term of this patent is extended or adjusted under 35 U.S.C. 154(b) by 0 days.

(21) Appl. No.: 13/860,700

(22) Filed: Apr. 11, 2013

(65) Prior Publication Data

US 2013/0269833 A1 Oct. 17, 2013

Related U.S. Application Data

(60) Provisional application No. 61/622,678, filed on Apr. 11, 2012.

(51) Int. Cl.

| | |
|---|---|
| ***B65B 39/00*** | (2006.01) |
| ***B67C 11/02*** | (2006.01) |
| ***B67C 11/00*** | (2006.01) |
| ***B67D 7/56*** | (2010.01) |

(52) U.S. Cl.

CPC ..... *B67C 11/00* (2013.01); *B67C 11/02* (2013.01); *B67D 7/565* (2013.01)

USPC ..... 141/338

(58) Field of Classification Search

CPC ..... F01M 2011/0491; B67C 11/02

USPC ..... 141/337, 338

See application file for complete search history.

(56) References Cited

U.S. PATENT DOCUMENTS

| | | | | |
|---|---|---|---|---|
| 4,112,984 | A | 9/1978 | Gugla et al. | |
| 4,896,746 | A | 1/1990 | Desjardins | |
| 5,074,343 | A | 12/1991 | Tyree, Jr. | |
| 5,195,567 | A * | 3/1993 | Tyree, Jr. | 141/331 |
| 5,316,059 | A | 5/1994 | Lahnan et al. | |
| 6,830,085 | B1 | 12/2004 | Majewski | |
| 2007/0079898 | A1 | 4/2007 | Grover et al. | |

* cited by examiner

*Primary Examiner* — Jason K Niesz
(74) *Attorney, Agent, or Firm* — Miltons IP/p.i.

(57) ABSTRACT

An apparatus for the transfer of a material into a storage container comprising a based, a funnel member attached to the base, and a sliding collar that nests in the base. The base attaches onto an exterior portion of the inlet of the storage container. The sliding collar includes a retaining member for retaining the sliding collar within the base, and one or more apertures. In addition, an upper portion of the sliding collar has a diameter larger than a diameter of the inlet member; and a lower portion of the sliding collar has a diameter less than the diameter of the inlet member.

9 Claims, 3 Drawing Sheets

FUNNEL CAP

TECHNICAL FIELD

The present device relates to the field of funnel-shaped apparatus, specifically apparatus used for pouring a substance into a storage container.

BACKGROUND

U.S. Pat. No. 4,112,984 discloses a funnel for attachment to a fuel tank engine-operated equipment. The funnel is provided with a cap, in turn having an air intake opening with an air filter. The funnel is thus always accessible for filling the tank.

U.S. Pat. No. 4,896,746 discloses a storage funnel designed for the retention of oil or a gasoline mixture for dispensing into an engine or tank. It may also be used to store parts. The storage funnel consists of a housing, a cover, a filler neck, a cap, and a second outer cover. The housing includes a rotatable valve for dispensing the liquid mixture.

U.S. Pat. No. 5,074,343 discloses a filler unit for filing small tanks. The unit attaches an inlet to such a tank, and allows for filling the tank without any spillage. The unit includes a body, a funnel, and a displacer integral with the funnel.

U.S. Pat. No. 5,316,059 discloses an oil filler funnel cap for internal combustion engines that includes an enlarged funnel receptacle with a resilient sealing closure.

U.S. Pat. No. 6,830,085 discloses a fuel tank inlet extension that includes a threaded translucent cylinder attached, at one end thereof, to a fuel tank inlet. Once the tank is filled to capacity, and the fuel therein rises within the attached cylinder, the original cap from the fuel tank inlet is attached to the body.

US Publication No. 20070079898 discloses a funnel-shaped device that includes a threaded spout for threading the device onto a head cover of an engine. The device includes ribbing at its widest juncture to assist in gripping the device.

SUMMARY

The device in its general form will first be described, and then its implementation in terms of specific embodiments will be described hereafter. These embodiments are intended to demonstrate the principle of the device, and the manner of its implementation. The device in its broadest and more specific forms will then be further described, and defined, in each of the individual claims which conclude this Specification.

In one aspect of the present invention, there is provided an apparatus for the transfer of a material into a storage container, the apparatus comprising: a) a base that attaches onto an exterior portion of an inlet member of the storage container; b) a funnel member attached to the base; and c) a sliding collar that nests in the base, the sliding collar having: i) a retaining member for retaining the sliding collar within the base; and ii) one or more apertures; wherein an upper portion of the sliding collar has a diameter larger than a diameter of the inlet member; and a lower portion of the sliding collar has a diameter less than the diameter of the inlet member.

The funnel member may be flexible such that it can fold over the base when the device is not in use.

The sliding collar includes: a lower portion containing a plurality of vent/weep slots and a retention member below the slots; and an upper portion having a threaded portion on an outside surface.

The threaded portion at the top of the sliding collar engages with the thread of the original cap of the storage container. The slot vents serve as an inlet for entry of a substance into the container, as well as providing ventilation for air to exit while the substance enters the container. The diameter of the retention ring (and thus, the diameter of the lower portion of the collar) is less than the diameter of the inlet. The retention member serves to prevent the collar from exiting the base.

In addition, the diameter of the upper portion of the collar is greater than the diameter of the storage inlet, thereby preventing the sliding collar from sliding into the storage container. That is, the upper portion of the collar abuts, or rests, on the outer edge of the inlet.

The device can be used to transfer liquids or solids into a storage container. For example, this device can used for the transfer of windshield washer fluid, antifreeze, transmission fluid, water, coolant, oil, fuel, chemicals (for gardening), fertilizer, sand, salt, spices, etc. As an optional feature, where the device is used for the transfer of liquid material, the device may incorporate a liquid level gauge that indicates the liquid or fuel level while the cap is closed or while filling the container.

The device can be used, for example, but not limited to, any gasoline-powered equipment. This may include, but is not limited to: lawn mowers, weed trimmers, chainsaws, generators, outboard motors, snow blowers, tillers, motorcycles, ATV, four-wheelers, snowmobiles and the like.

The foregoing summarizes the principal features of the device and some of its optional aspects. The device may be further understood by the description of the embodiments which follow.

Wherever ranges of values are referenced within this specification, sub-ranges therein are intended to be included unless otherwise indicated. Where characteristics are attributed to one or another variant of the device, unless otherwise indicated, such characteristics are intended to apply to all other variants of the device where such characteristics are appropriate or compatible with such other variants.

DESCRIPTION OF PREFERRED EMBODIMENT

The following is given by way of illustration only and is not to be considered limitative of this device. Many apparent variations are possible without departing from the scope thereof.

Figure 1:
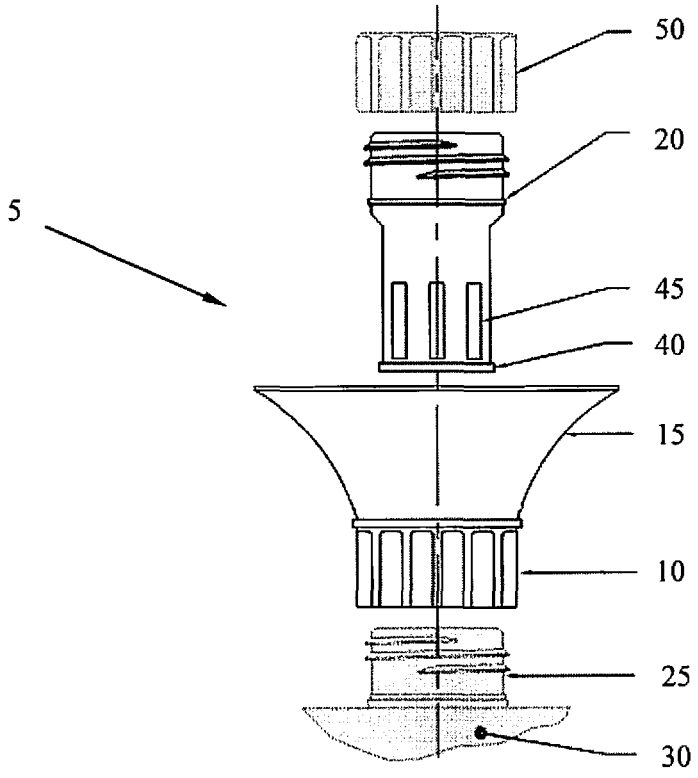
FIG. 1 illustrates an exploded view of an embodiment of the funnel cap.
Figure 2:
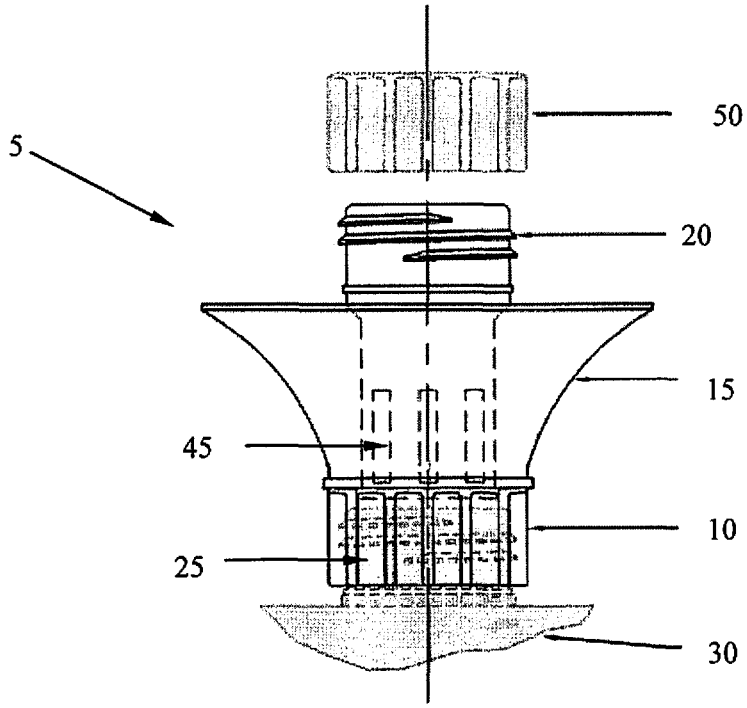
FIG. 2 illustrates an assembled view the funnel cap shown in FIG. 1, in an open position.
Figure 3:
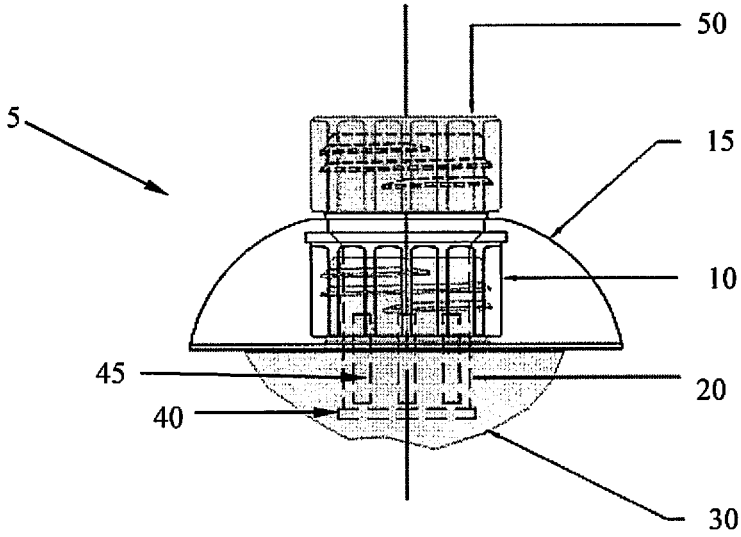
FIG. 3 illustrates an assembled view the funnel cap shown in FIG. 1, in a closed position.

FIG. 1 illustrates a disassembled view of an embodiment of the funnel cap (5), which includes three components: a base (10), a flexible funnel (15), and a sliding collar (20). While the embodiment shown in FIGS. 1-3 illustrates a flexible funnel, the device can also operate with a non-flexible funnel.

The base (10) is positioned above an inlet (25) of storage container (30). The base (10) is threaded on an interior surface thereof, in order to thread onto the inlet (25).

The flexible funnel (15) is positioned above the base (10). In FIG. 1, the funnel (15) is shown in an upright position, although it can be folded into downward position, as shown by the dotted lines. In the embodiment shown in FIGS. 1 to 3, the funnel (15) is integral with the base (10). The funnel (15)

and the base may act as a single unit in order to remain secured on the inlet (25) between refilling the storage container (30). For example the device (5) may be secured onto the inlet (25) of container which forms part of equipment, while the equipment is operating.

The sliding collar (20) is positioned above the funnel (15). The sliding collar (20) has a lower retaining ring (40) to stop the sliding collar (20) from being pulled out from the base (10). While an exploded version of the device (5) is shown in FIG. 1, it is understood that in the assembled device (5), the sliding collar (20) is retained within the base (10). In addition, the sliding collar (20) includes a multiplicity of vent/weep slots (45) on a lower portion thereof. Furthermore, the lower portion and the retaining ring (40) each have a diameter that is less than the diameter of the inlet (25), while the upper portion of the sliding collar (20) has a diameter that is greater than the diameter of the inlet (25). In this manner, the upper portion of the sliding collar (20) abuts the exterior of the inlet (25), and therefore, the sliding collar (20) cannot fall into the inlet (25).

Prior to using the funnel cap (5) for the transfer of material into the storage container (30), the original cap (50) of the storage container (30) is removed. The funnel cap (50) is then secured to the inlet (25), in place of the original cap (50). The sliding collar is lifted to its maximal position, as shown in FIG. 2, by engagement with the inner surface of the base (10). For example, the retaining ring (40) can engage with a thread or temporary locking mechanism (not shown) in the upper inner surface of base (10). When the sliding collar (20) is not in use, it is unlocked from its upright position, and slides downwards into the inlet (25), as shown in FIG. 3).

The original cap (50), which closes the inlet (25), is now positioned above the sliding collar (20), and secures onto the sliding collar (20) when the funnel cap (5) is not in use.

FIG. 2 illustrates an assembled funnel cap (5), ready for use. The original cap (50) is first removed. The base (10) is threaded onto the inlet (25), while the flexible funnel (15) is in upright position. The sliding collar (20) is lifted and locked into an upright position by engagement with an inner surface of the base (10). For example, the sliding collar (20) may be threadingly engaged with the base (10), so that it locks into place by a slight twist.

Material can be transferred to the container (30) in a number of ways. In one method, the material is transferred to the funnel (15), and enters the container (30) through the vent/weep slots (45) of the sliding collar (20). The vent/weep slots (45) therefore operate as entry points of the material into the container (30). In this configuration, the original cap (50) can remain in place (i.e. secured onto the top of the sliding collar (20)), with no need to remove it.

In another method, the original cap (50) is removed from the sliding collar (20), and the material is poured through the sliding collar (20). A portion of the material will flow directly into the storage container (30), while a portion may first exit through the multiple slots (45) or overflow out of the sliding collar (20) into the surrounding funnel (15), and then subsequently re-enter the slots (45), through the inlet (25) and into the container (30).

Once the transfer of material is complete, the funnel cap (5) can be closed, as shown in FIG. 3. The sliding collar (20) is disengaged from the base (10) and its lower portion slides down into the inlet (25), while its upper portion rests on the exterior of the inlet (25). Optionally, a gasket and/or seal may be affixed to part of the sliding collar (20) in order prevent liquid from leaking back out from the container (30) once the sliding collar (20) sits in the inlet (25). The original cap (50) is then threaded onto the upper portion of the sliding collar (20). The flexible funnel (15) can then be folded over the base (10).

As an optional feature, the device may incorporate a liquid (fuel) level gauge that indicates the liquid or fuel level while the funnel cap is closed or while filling the container. For example, such a gauge can include a float device (below the cap) that moves up and down with a piece of lightweight material (e.g. foam) to indicate the liquid level in the container. The float is connected to a gauge visible on the outside of the cap that would indicates the level of liquid within the container.

The device may be used as follows. First, the original cap of the storage container is removed. Next, the device is inserted into the inlet of a storage container. The base is threaded onto the inlet to secure the device thereto. The bottom portion of the sliding collar slides into the inlet and tand, with the top portion of the collar sitting atop the inlet. Next, the sliding collar is pulled upwards and temporarily locked in that position (by engagement of the bottom portion of the collar with an inner surface of the base), so that the vent/weep slots are unobstructed by inlet.

As described above, material can be transferred into the container in either of two ways. In one method, with the original inlet cap removed, the material is poured directly into the sliding collar. A portion of the material will then go directly into the container, while another portion may overflow into the funnel at first, and then flow into the container via the slots. The funnel thus acts as a secondary means of directing liquid into the container and avoiding spills.

In another method, where the original cap is secured to the top portion of the collar (and thus obstructs the entry of the collar), the material is poured into the funnel itself, entering the container through the vent/weep slots of the collar.

Once the material is poured into the container, the sliding collar is disengaged from the base, and slides down into the storage inlet, with the top portion of the sliding collar resting on an outer edge of the storage inlet. The original inlet cap is threaded onto the upper portion of the sliding collar, and the funnel member is folded down over the base. This can be described as a "closed" position of the device.

The device can remain secured to the storage inlet (in the "closed" position as described above), between refuelling. The device can also remain attached in the closed position while the equipment is in use. Alternatively, it can be removed altogether.

CONCLUSION

The foregoing has constituted a description of specific embodiments showing how the device may be applied and put into use. These embodiments are only exemplary. The device in its broadest, and more specific aspects, is further described and defined in the claims which now follow.

These claims, and the language used therein, are to be understood in terms of the variants of the device which have been described. They are not to be restricted to such variants, but are to be read as covering the full scope of the device as is implicit within the disclosure that has been provided herein.

I claim:

1. An apparatus for the transfer of a material into a storage container, the apparatus comprising: a base that attaches onto an exterior portion of an inlet member of the storage container; a funnel member attached to the base; and a sliding collar that nests in the base, the sliding collar having: i) a retaining member for retaining the sliding collar within the base; and ii) one or more apertures; wherein an upper portion of the sliding collar has a diameter larger than a diameter of the inlet member; and a lower portion of the sliding collar has a diameter less than the diameter of the inlet member, wherein the funnel member is flexible and folds over the base.

2. The apparatus of claim 1, wherein the retaining member engages with an inner surface of the base for temporarily locking the sliding collar to the base.

3. The apparatus of claim 1, wherein the material is a liquid.

4. The apparatus of claim 3, wherein the material is selected from the group consisting of fuel, windshield washer fluid, antifreeze, transmission fluid, water, coolant, and oil.

5. The apparatus of claim 1, wherein the material is a solid.

6. The apparatus of claim 5, wherein the material is selected from the group consisting of chemicals, sand and fertilizer.

7. The apparatus of claim 1, for use on equipment selected from the group consisting of a lawn mower, a weed trimmer, a chainsaw, a generator, an outboard motor, a snow blower, a tiller, a motorcycle, an ATV, a four-wheeler and a snowmobile.

8. The apparatus of claim 1, further comprising a liquid level gauge.

9. The apparatus of claim 1, wherein the sliding collar comprises one or more vent slots on a lower portion.

* * * * *